US006680716B2

(12) United States Patent
Nakamura

(10) Patent No.: US 6,680,716 B2
(45) Date of Patent: Jan. 20, 2004

(54) DRIVING METHOD FOR PLASMA DISPLAY PANELS

(75) Inventor: Tadashi Nakamura, Tokyo (JP)

(73) Assignee: NEC Corporation (JP)

( * ) Notice: Subject to any disclaimer, the term of this patent is extended or adjusted under 35 U.S.C. 154(b) by 76 days.

(21) Appl. No.: 09/802,364

(22) Filed: Mar. 9, 2001

(65) Prior Publication Data

US 2002/0021264 A1 Feb. 21, 2002

(30) Foreign Application Priority Data

Mar. 10, 2000 (JP) ..... 2000-067603

(51) Int. Cl.[7] ..... G09G 3/28

(52) U.S. Cl. ..... 345/60; 345/62; 345/63; 345/66; 345/67; 345/72

(58) Field of Search ..... 345/60, 62–63, 345/66–67, 72

(56) References Cited

U.S. PATENT DOCUMENTS 5,757,343 A * 5/1998 Nagakubo ..... 345/63
6,115,011 A * 9/2000 Sano et al. ..... 345/64
6,133,903 A * 10/2000 Lee et al. ..... 345/691
6,369,782 B2 * 4/2002 Shigeta ..... 345/63
6,388,645 B2 * 5/2002 Kasahara et al. ..... 345/63
6,414,658 B1 * 7/2002 Tokunaga ..... 345/63
6,465,970 B2 * 10/2002 Nagakubo et al. ..... 315/169.4
6,476,801 B2 * 11/2002 Nagai ..... 345/213
2002/0167469 A1 * 11/2002 Todoroki et al. ..... 345/63

FOREIGN PATENT DOCUMENTS

JP 08-138015 * 5/1996
JP 2639311 4/1997 ..... G09G/3/28
JP 09-319330 12/1997 ..... G09G/3/28

* cited by examiner

*Primary Examiner*—Bipin Shalwala
*Assistant Examiner*—Shapiro Leonid
(74) *Attorney, Agent, or Firm*—Hayes Soloway P.C.

(57) ABSTRACT

Sustaining discharges are conducted in a first sub-field in a pair of adjacent first and second sub-fields. Then, writing discharges in a second sub-field are conducted after the sustaining discharges in the first sub-field without conducting any erasure discharge between the sustaining discharges and the writing discharges. A relation expressed by an equation $L_1=L_2=1$ and an inequality $L_{n+2} \leqq L_{n+1}+L_n$ holds for a luminance weighting $L_i$. The luminance weighting $L_i$ is a luminance weighting of the i-th lowest sub-field from the bottom among the plurality of sub-fields.

7 Claims, 14 Drawing Sheets

SF12
SF11
SF10
SF9
SF8
SF7
SF6
SF5
SF4
SF3
SF2
SF1

SUSTAINING DISCHARGE PERIOD
WRITING DISCHARGE PERIOD
PRIMING DISCHARGE PERIOD
ERASURE DISCHARGE PERIOD

DRIVING METHOD FOR PLASMA DISPLAY PANELS

BACKGROUND OF THE INVENTION

1. Field of the Invention

The invention relates to a driving method for plasma display panels used for a flat screen type television, an information display and the like, in particular, to a driving method which can reduce false contours in dynamic images in a sub-field method.

2. Description of the Related Art

Plasma display panels ("PDP") have many advantages such that they have thinner structures, provide less flickers and larger display contrasts, can be easily built into large screen sizes, have faster response speeds, and are capable of multicolor luminance by using phosphors as they are emissive type. Consequently, they are becoming quite popular as computer-related displays and other color image displays.

The PDP can be divided based on their operating principles into an AC type one, which operates under an alternating current discharge state indirectly with the electrodes covered with dielectric materials, and a DC type one, which operates under a direct current discharge state with the electrodes being exposed to a discharge space. Moreover, the AC type PDP can be divided depending on the driving method into a memory operating type, which uses a memory function of each discharge cell, and a refresh operating type, which doesn't use the function. The intensity of a PDP is proportional to the number of discharges. Since the intensity of the refresh type reduces as the display capacity increases, it is primarily used as a small display capacity PDP.

FIG. 1 is a perspective drawing showing the structure of display cells of a typical AC type PDP, and FIG. 2 is a cross-sectional drawing of the same.

A display cell 16 has two insulating substrates 1 and 2 made of glass. The insulating substrate 1 is a back substrate and the insulating 2 is a front substrate.

One side of the insulating substrate 2 that is facing the insulating substrate 1 is provided with transparent scanning electrodes 3 and transparent sustaining electrodes 4. The scanning electrodes 3 and the sustaining electrodes 4 extend in the horizontal direction (transverse direction) of the panel. Bus electrodes 5 and 6 are arranged so as to overlay upon the scanning electrodes 3 and the sustaining electrodes 4, respectively. The bus electrodes 5 and 6 can be made of a metal and are provided there to minimize the electrical resistance value between each electrode and the external drive unit. A dielectric material layer 12 is provided to cover the scanning electrodes 3 and the sustaining electrodes 4. Also provided is a protective layer 13 made of magnesium oxide or the like for the purpose of protecting the dielectric layer 12 from discharges.

A data electrode 7 is provided in a direction perpendicular to those of the scanning electrodes 3 and the sustaining electrodes 4 on one side of the insulating substrate 1 that faces the insulating substrate 2. Thus, the data electrode 7 extends in the perpendicular direction (vertical direction) of the panel. Partition walls 9 are separating the display cells in the horizontal direction. A dielectric layer 14 is provided to cover the data electrodes 7. A phosphor layer 11 is formed in such a way as to cover the side surfaces of the partition walls 9 and the surface of the dielectric layer 14 in order to convert an ultraviolet light generated by a discharge of discharge gas into visible light 10. A discharge gas space 8 is secured with the partition walls 9 between the insulating substrates 1 and 2, and discharge gas containing helium, neon, xenon or the like, or a mixture of these gases fills the discharge gas space 8.

The discharge operation will be described that occurs in a display cell 16 selected on a conventional PDP constituted as described above.

When discharge starts as the pulse voltage higher than the discharge threshold value is applied between the scanning electrode 3 and the data electrodes 7, positive and negative charges will be attracted to the surfaces of the dielectric layers 12 and 14 and electric charges will accumulate in response to polarity of the pulse voltage. An equivalent internal voltage caused by the accumulation of charges, i.e., the wall voltage, has a polarity opposite to that of the pulse voltage. Thus, with the progress of the discharge, the effective voltage inside the cell drops, and will become impossible to sustain the discharge even if the pulse voltage is maintained at a constant value, and eventually the discharge will stop.

However, when a sustaining discharge pulse, which has the same polarity as the wall voltage, is applied between adjacent scanning electrodes 3 and sustaining electrodes 4, the wall voltage will be added to them as the effective voltage. Therefore, even if the voltage amplitude of the sustaining discharge pulse is respectively low, the effective voltage will exceed the discharge threshold value, and discharge will occur. Consequently, by applying a sustaining discharge pulse between the scanning electrodes 3 and the sustaining electrodes 4 reciprocally, the discharge becomes sustainable. This is the abovementioned memory function.

Moreover, by applying to the scanning electrodes 3 or the sustaining electrodes 4 an erasure pulse such as a wide and low voltage pulse that neutralizes the wall voltage, or a narrow width pulse with a voltage comparable to the sustaining discharge pulse voltage, the sustaining discharge can be stopped.

FIG. 3 is a block diagram showing the outline of a PDP formed by arranging display cells such as the one shown in FIG. 2 in a matrix as well as control circuits and drivers for the PDP.

A PDP 15 is a dot matrix display panel where display cells 16 typically shown in FIG. 2 in a matrix of m-rows and n-columns. Scanning electrodes X1, X2, . . . , Xm and sustaining electrodes Y1, Y2, . . . Ym are arranged parallel to each other as row electrodes, and data electrodes D1, D2, . . . , Dn are arranged perpendicular to the scanning electrodes and the sustaining electrodes as column electrodes.

A control circuit 31 is equipped with a frame memory 32 that stores image data for sub-fields that constitute a frame. It is also equipped with a signal processing memory control circuit 33 that receives vertical synchronous signal Vsync, horizontal synchronous signal Hsync, clock signal Clock and data DATA to read the data for sub-fields in the frame memory 32 based on those signals. The vertical synchronous signal Vsync is a signal to instruct the cycle for one frame and the starting point on the display screen for the cycle. For example, in case of constituting a frame asynchronous with the clock signal Clock, the vertical synchronous signal Vsync is to designate the leading display data DATA for the entire screen. The horizontal synchronous signal Hsync is a signal that instructs capture of display data for each horizontal scanning line. The horizontal synchronous signal Hsync corresponds to a signal that instructs the start of scanning for each horizontal scan in a cathode ray tube (CRT) display. A driver control circuit 34 is also provided for controlling the operation of the PDP 15 in relation to the output signal of the signal processing memory control circuit 33.

Further provided here a scan driver 21 that generates a scanning electrode drive pulse based on control signals received from the control circuit 31 and applies it to the scanning electrodes X1, X2, . . . , Xm, a sustain driver 22 that generates a sustaining electrode drive pulse based on control signals received from the control circuit 31 and applies it to the sustaining electrodes Y1, Y2, . . . Ym, and an address driver 20 that generates a data electrode drive pulse based on control signals received from the control circuit 31 and applies it to the data electrodes D1, D2, . . . , Dn.

Next, the prior driving method for the PDP shown in FIG. 3 will be described. FIG. 4 is a conceptual drawing showing one frame in the prior driving method, and FIG. 5 is a timing chart showing waveforms of the drive pulses outputted from the address driver 20, the scan driver 21 and the sustain driver 22 within one sub-field. In FIG. 5, Wu represents the sustaining electrode drive pulse applied to the sustaining electrodes Y1, Y2, . . . Ym, Ws1, Ws2, . . . , Wsm represent the scanning electrode drive pulses applied to the scanning electrodes X1, X2, . . . , Xm respectively, and Wd represents the data electrode drive pulse applied to the data electrodes Di ($1 \leqq i \leqq n$).

As shown in FIG. 4, one frame consists of eight sub-fields SF1 through SF8, for example, and one sub-field (one cycle of drive) consists of four periods, i.e., a priming discharge period, a writing discharge period, a sustaining discharge period, and an erasure discharge period, and the cycle is repeated to obtain the display of a desired image.

The priming discharge period is a period for generating active particles and wall charges in the discharge gas space in order to achieve a stable writing discharge characteristic during the writing discharge period. During the priming discharge period, first of all, a priming discharge pulse Pp is applied to the scanning electrodes X1, X2, . . . , Xm to cause discharges at all of display cells in the PDP 115 as shown in FIG. 5. Next, the voltage level of the sustaining electrodes Y1, Y2, . . . Ym is raised to the sustaining voltage level Vs and a priming discharge erasure pulse Ppe is applied to the scanning electrodes X1, X2, . . . , Xm to bring down their voltages gradually in order to cause the erasure discharges. As a result, the portion of the wall charges thus created that hinders subsequent writing discharges and sustaining discharges to be erasure. The "erasure of wall charges" mentioned here means not only the erasure of entire wall discharges but also includes the "adjustment of amount of wall charges" for conducting the subsequent writing discharges and sustaining discharges smoothly.

During the writing discharge period, a certain scanning base voltage Pwb is applied to the scanning electrodes X1, X2, . . . , Xm, and a scanning pulse Pw is applied as well sequentially from the top of the scanning electrodes X1, X2, . . . , Xm. A data pulse Pd is applied selectively in synchronization with the scanning pulse Pw to the data electrodes Di ($1 \leqq i \leqq n$) in the display cells that are to make displays. Consequently, writing discharges occur and wall charges are accumulated at the cells that are to make displays.

During the sustaining discharge period, a sustaining discharge pulse Pc is applied to the sustaining electrodes Y1, Y2, . . . Ym, while a sustaining discharge pulse Ps, whose phase is 180 degrees lagging that of the sustaining discharge pulse Pc, is also applied to the scanning electrodes X1, X2, . . . , Xm, so that the sustaining discharges can be repeated in order to obtain a desired intensity for each sub-field of the display cells where the writing discharges occur during the writing discharge period.

In the final erasure discharge period, erasure discharges are generated as the erasure pulse Pe is applied to the scanning electrodes X1, X2, . . . , Xm in order to drop their potentials slowly. As a result, the wall charges accumulated by the application of the sustaining discharge pulses Pc and Ps are erased. The "erasure of wall charges" mentioned here also means not only the erasure of entire wall discharges but also includes the "adjustment of amount of wall charges" for conducting the subsequent writing discharges and sustaining discharges smoothly.

The driving method described above is used for conducting displays on a typical AC type PDP of the prior art. The intensity in black display (background intensity) is determined relative to luminance with the priming discharge. There is a priming charging period exists for each sub-field in the driving method, so that luminance occurs a plurality of times due to the priming discharge unrelated to the display image during one frame period. As a result, it has a problem that the background intensity increases and causes a degradation of contrast if the number of sub-fields is increased in order to increase the number of gradations or picture quality.

In order to cope with this problem, another driving method for a PDP was proposed to achieve reductions of the priming discharge period and the erasure discharge period during one frame (Japanese Patent No. 2639311). Hereinafter, this driving method will be called a first prior art. FIG. 6 is a conceptual drawing of one frame according to a driving method for a PDP according to the first prior art.

In the first prior art, a sub-field group is formed of arranging a plurality of sub-fields of the same luminance intensity, a group containing sub-fields SF9, SF8 and SF7, another group containing sub-fields SF6, SF5 and SF4, another group containing sub-fields SF3, SF2 and SF1. Writing and erasure of each display cell are provided only once for a single sub-field group and a priming discharge period is provided between the sub-field groups.

This reduces the priming discharge frequency, thus reducing the background intensity and improving the display contrast.

Also, a driving method of providing the lowest sub-field (LSF) immediately after the highest sub-field (MSF) without providing the priming discharge period between them, and a driving method of providing a sub-field one level higher than the lowest sub-field immediately after a sub-field one level lower the highest sub-field without providing the priming discharge period between them (Japanese Unexamined Patent Publication No. Hei 9-319330). Hereinafter, the former driving method disclosed in the Japanese Unexamined Patent Publication No. Hei 9-319330 will be called a second prior art. FIG. 7 is a conceptual drawing of one frame according to the driving method of a PDP according to the second prior art.

If the highest sub-field (MSF) is chosen in the second prior art, the lowest sub-field (LSF) will automatically be selected. As a result, the number of writing erasure periods per one frame will be reduced.

However, although the original object is achieved in the first prior art, it has a problem that it is difficult to realize a more sophisticated display device since the flexibility is limited as the luminance intensities of the sub-fields are constant within one sub-field group. For example, a problem occurs when the sustaining discharge frequency within one frame is switched according to the signal level.

Since the intensity of the PDP depends on the sustaining discharge frequency, the improvement of the intensity is realized by increasing the number of sustaining pulses. The power consumption becomes too large if it is tried to achieve a sufficient intensity in such a PDP. A peak intensity enhancing control method is known, in which the power consumption is lowered by reducing the sustaining discharge frequency if the average picture level of the image signal is high, and the sustaining discharge frequency is increased in order to achieve a high contrast feeling by increasing the intensity of small regions if the average picture level is low.

For example, if the peak intensity enhancing control method is applied to the first prior art by assuming that the number of sub-fields in each sub-field group is two, the minimum number of sustaining discharges that are adjustable relative to the average picture level change is two. This is due to the fact that reducing the number of sustaining discharges one at a time becomes smallest in order to have uniform sub-field luminance intensity within a sub-field group. Consequently, one step of display intensity variation according to the signal level change may become too large in some cases, and this step of intensity variation may become unpleasant for the viewer.

A major problem in gradation expression based on the sub-filed method is in general that the contour interference occurs when dynamic images are displayed. This interference is generally called "dynamic image false contour" and is caused by the fact that the regularity of the luminance period varies when the display image moves. The sub-field method is a method of providing a plurality of sub-fields weighted with various intensities and changing the combination of the selected sub-fields in order to change the average intensity within a frame. Human eyes feel the integrated value of the luminance within a frame in the frame frequencies of 60 Hz or higher, at which flickers cannot be detected as the intensity of the display image. However, if there is a movement in an image with intermittent luminance, human eyes tend to follow the image as a habit and, when an irregularity of intermittent luminance appears at a place where the image existed in the previous frame, the person feels it brighter if the interval is short and darker if the interval is longer than the actual change of the average intensity of the frame.

There has been many driving methods proposed to correct dynamic image false contours, among which a driving method called the redundancy coding method has been known to be particularly effective, wherein a large number of sub-fields are used to have a large number of sub-field combinations to correspond with a signal level. In order to apply the first prior art to this redundancy coding method, it will be necessary to further increase the number of sub-fields. However, there is a limit for elongating the duration of one frame as it is necessary to maintain the frequency within the range (higher than approximately 60 Hz) which human eyes do not detect flickers. Therefore, there is a practical limit for increasing the number of sub-fields. Even if it is possible to increase it, it will cause a problem that the sustaining discharge period becomes insufficient and intensity decreases as a result.

In the second prior art, on the other hand, there is a problem that the lowest sub-field is automatically chosen with the selection of the higher sub-field, so that the minimum change of the gradation level in an image expressed with signals of higher intensity level increases and the number of practical gradation steps decreases.

SUMMARY OF THE INVENTION

The object of the present invention is to provide a driving method for plasma display panels capable of maintaining high contrasts by reducing background intensity and simultaneously reducing dynamic image false contours by suppressing the variation of the image intensity.

According to one aspect of the present invention, a driving method for plasma display panel wherein gradation is expressed by dividing one frame into a plurality of sub-fields comprises the steps of conducting sustaining discharges in a first sub-field in a pair of adjacent first and second sub-fields, and conducting writing discharges in the second sub-field after the sustaining discharges in the first sub-field without conducting any erasure discharge between the sustaining discharges in the first sub-field and the writing discharges in the second sub-field. A relation expressed by an equation $L_1=L_2=1$ and an inequality $L_{n+2} \leqq L_{n+1}+L_n$ holds for a luminance weighting $L_i$. The luminance weighting $L_i$ is a luminance weighting of the i-th lowest sub-field from the bottom among the plurality of sub-fields.

In the present invention, writing discharges for the second sub-field, which generates luminance later, are conducted immediately after conducting sustaining discharges for the second sub-field, which generates luminance earlier among a pair of adjacent first and second sub-fields. Therefore, there exist some sub-fields having no priming discharge. Thus, it is possible to sustain contrasts higher by reducing the background luminance. Also, since the weighting of intensity in each sub-field is only required to satisfy the relation expressed by the equation $L_1=L_2=1$ and the inequality $L_{n+2} \leqq L_{n+1}+L_n$, many gradation levels exist where many combinations of sub-fields that express the gradation levels exist. Therefore, it is possible to suppress the variation of the image intensity by increasing the redundancy and reduce dynamic false contours by suppressing one step of the intensity variation.

According to another aspect of the invention, a driving method for plasma display panel wherein gradation is expressed by dividing one frame into a plurality of sub-fields comprises the steps of preparing frames in each of which number of priming discharge periods is set up in relation to an average picture level of images, the number of sub-fields in the frames being equal to one another, selecting a frame from the frames in accordance with a average picture level, conducting sustaining discharges in a first sub-field in a pair of adjacent first and second sub-fields, and conducting writing discharges in the second sub-field after the sustaining discharges in the first sub-field without conducting any erasure discharge between the sustaining discharges and the writing discharges in case when the number of priming discharge periods in a selected frame is less than the number of sub-fields in the selected frame.

In the first embodiment, one frame consists for 12 sub-fields SF1 through SF12 and one priming discharge period is provided for two sub-fields. Specifically, priming discharge periods are provided only for SF2, SF4, SF6, SF8, SF10, and SF12, and no priming periods are provided for SF1, SF3, SF5, SF7, SF9, and SF11.

The first example of the method of selecting sub-fields (coding) is shown in Table 1. Table 1 shows the relation between the weighting of the intensity of each sub-field and the gradation level expressed by their combinations.

TABLE 1

| | Weighting | | | | | | | | | | | |
|---|---|---|---|---|---|---|---|---|---|---|---|---|
| Gradation level | SF 12 91 | SF 11 58 | SF 10 36 | SF9 24 | SF8 16 | SF7 11 | SF6 7 | SF5 5 | SF4 3 | SF3 2 | SF2 1 | SF1 1 |
| 0 | | | | | | | | | | | | |
| 1 | | | | | | | | | | | | ○ |
| 2 | | | | | | | | | | | ○ | ○ |
| 3 | | | | | | | | | | ○ | | ○ |
| 4 | | | | | | | | | | ○ | ○ | ○ |
| 5 | | | | | | | | | ○ | ○ | | |
| 6 | | | | | | | | | ○ | ○ | | ○ |
| 7 | | | | | | | | | ○ | ○ | ○ | ○ |
| 8–12 | | | | | | | | ○ | | Same as gradation level 3–7 | | |
| 13–19 | | | | | | | ○ | ○ | | Same as gradation level 1–7 | | |
| 20–30 | | | | | | ○ | | Same as gradation level 9–19 | | | | |
| 31–46 | | | | | ○ | ○ | | Same as gradation level 4–19 | | | | |
| 47–70 | | | | ○ | | | Same as gradation level 23–46 | | | | | |
| 71–106 | | | ○ | ○ | | | Same as gradation level 11–46 | | | | | |
| 107–164 | | ○ | | | | Same as gradation level 49–106 | | | | | | |
| 165–255 | ○ | ○ | | | | Same as gradation level 16–106 | | | | | | |

Figure 11:
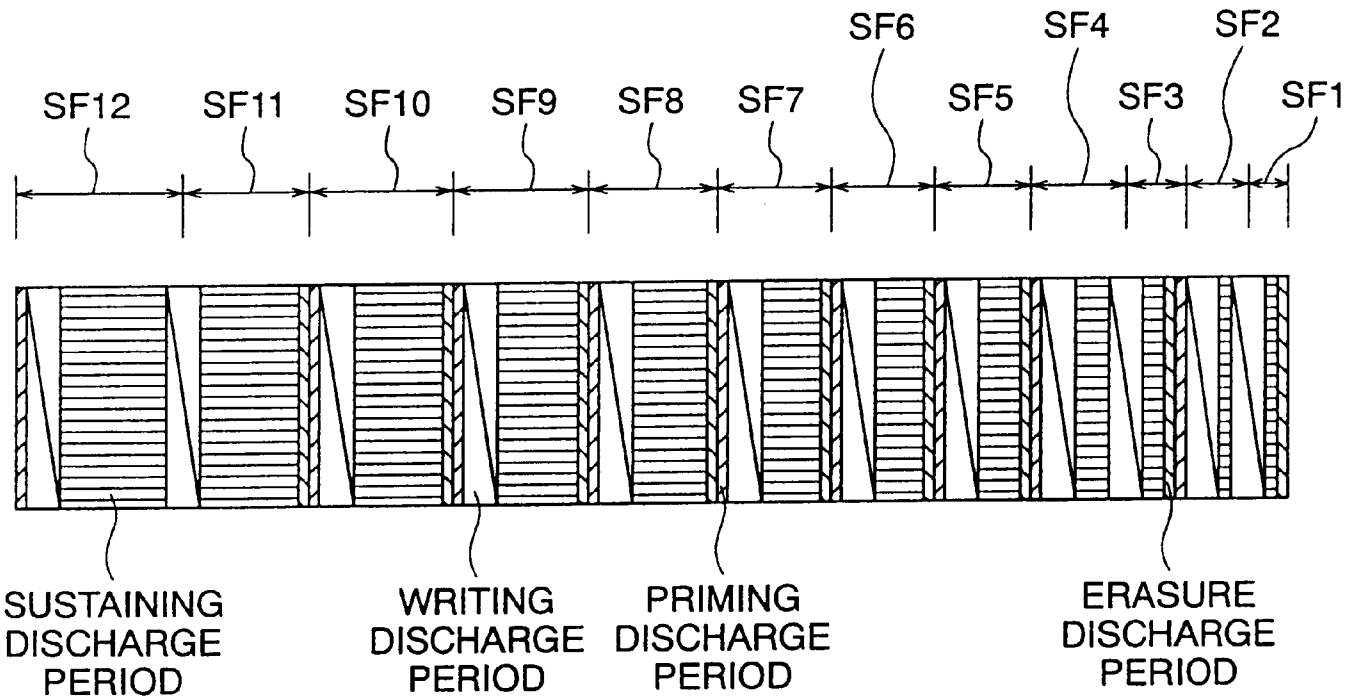

FIG. 11 is a conceptual drawing showing one frame in a driving method for PDP according to a third embodiment of the present invention.

FIG. 12A through FIG. 12D are conceptual drawings showing one frame setup in relation to APL in a driving method for PDP according to a fourth embodiment of the present invention.

FIG. 13A through FIG. 13F are conceptual drawings showing one frame setup in relation to APL in the driving method for PDP according to a fifth embodiment of the present invention.

Figure 14:
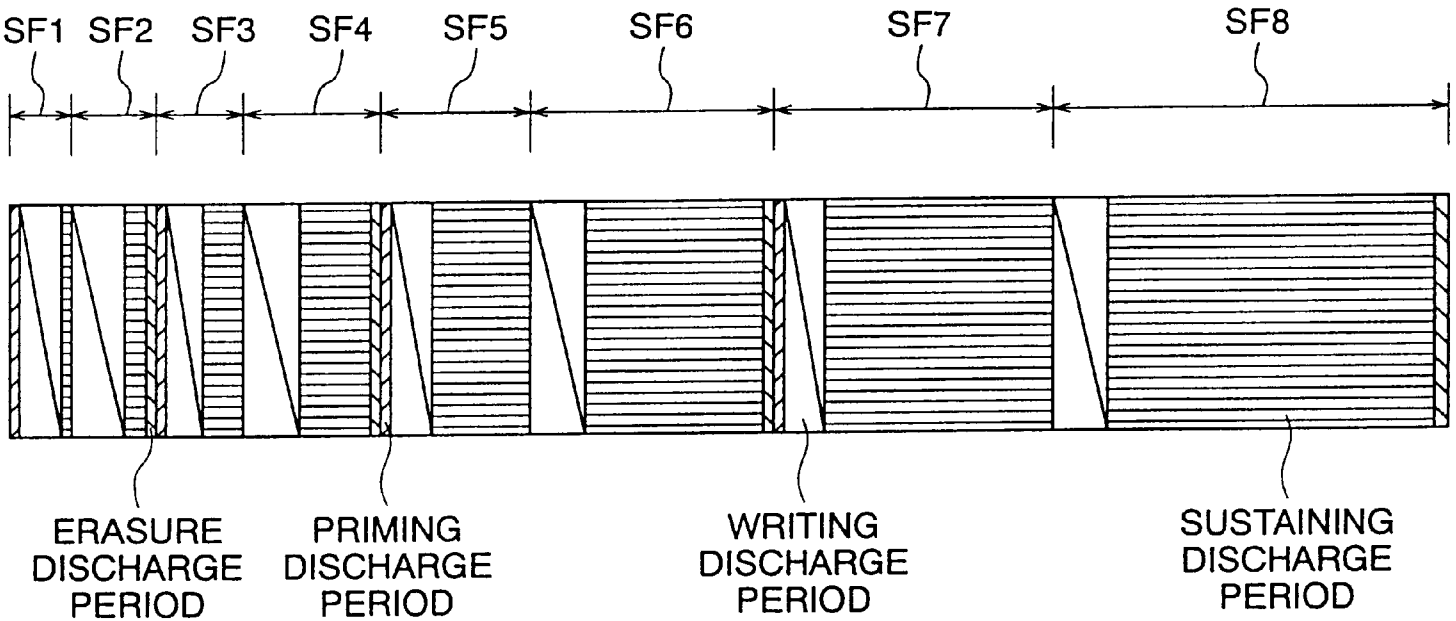

FIG. 14 is a conceptual drawing showing one frame in an erasure-selection-type driving method that allows selective luminance.

THE PREFERRED EMBODIMENTS OF THE INVENTION

Figure 8:
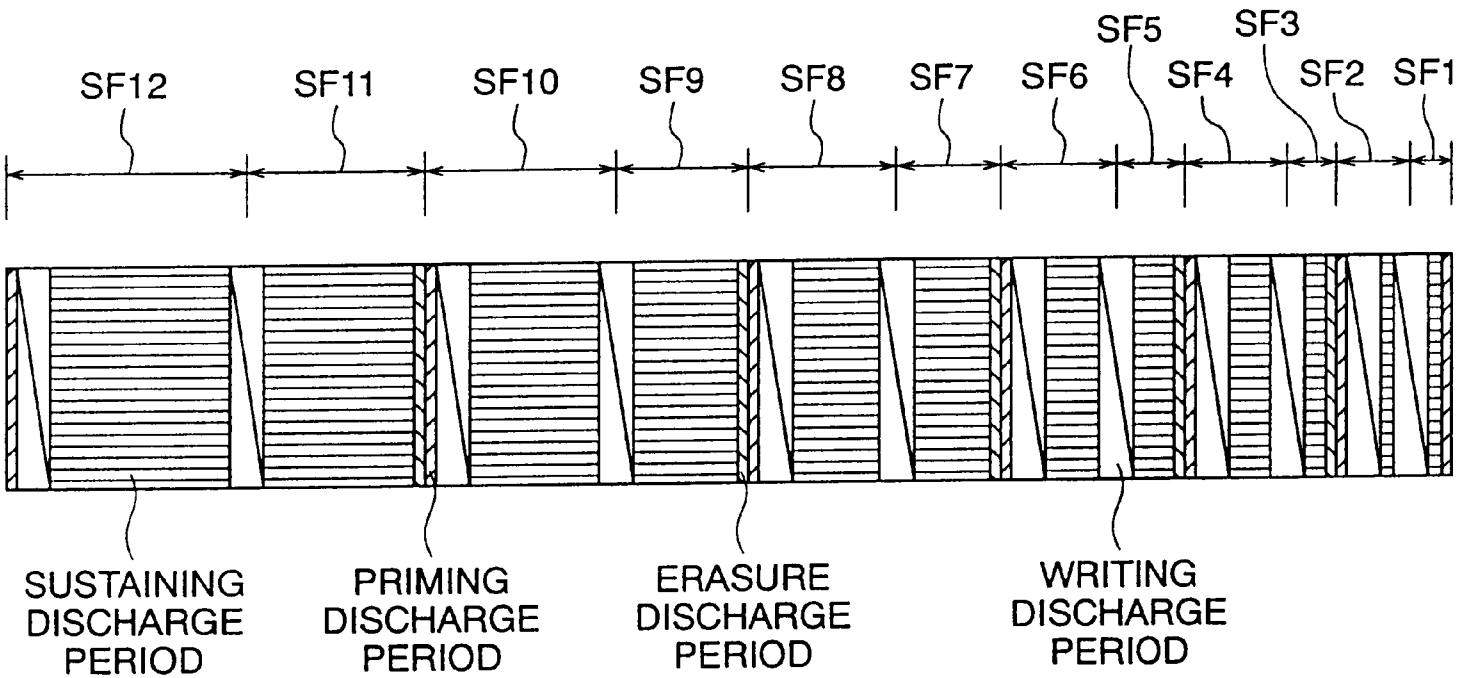
FIG. 8 is a conceptual drawing showing one frame in a driving method for PDP according to a first embodiment of the present invention.

Preferred embodiments of the driving method for PDP according to the invention will be described in details referring to the accompanying drawings. FIG. 8 is a conceptual drawing showing one frame in the driving method for PDP according to the first embodiment of the present invention.

Figure 9:
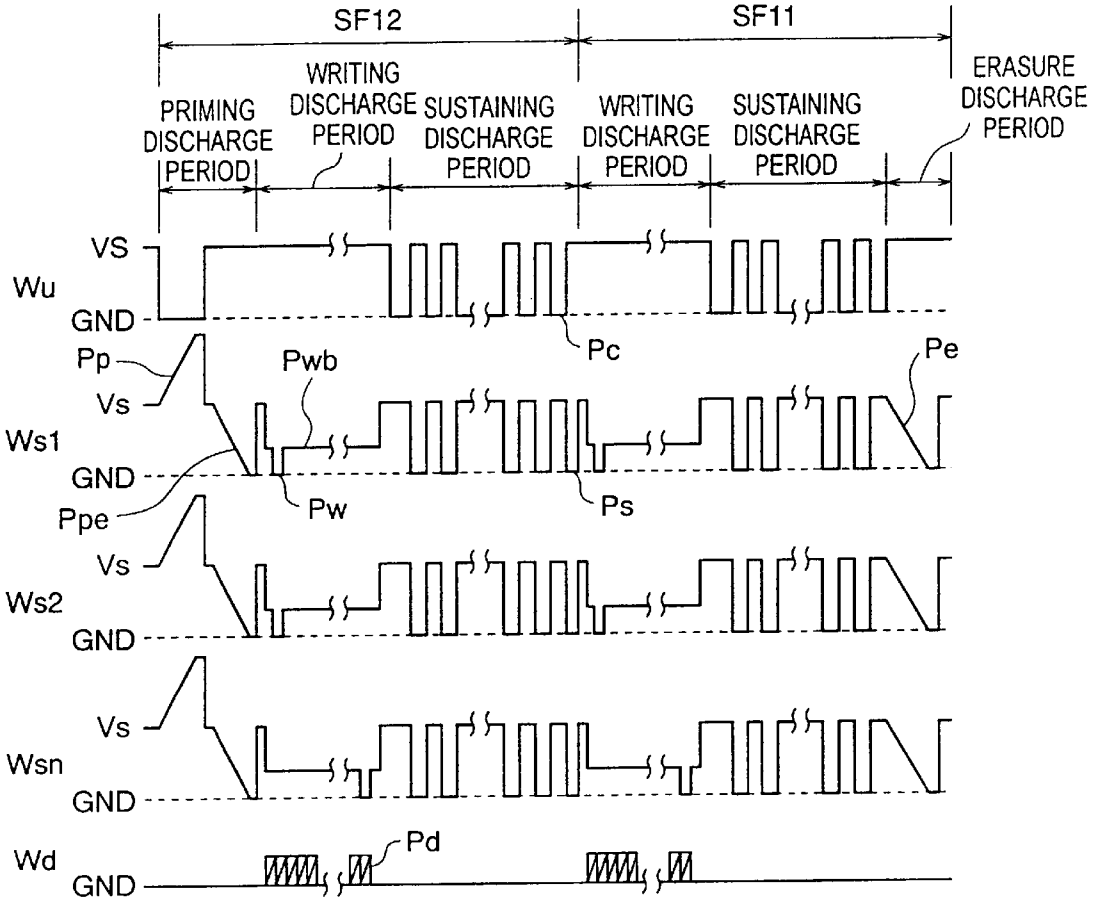
FIG. 9 is a timing chart showing waveforms of each driving pulse in the sub-fields SF11 and SF12 in the first embodiment of the present invention.

Next, it will be describe about the specific driving method in the first embodiment, where a frame is constituted, each sub-field is weighted and each gradation level is set, as shown above. FIG. 9 is a timing chart showing each drive pulse waveform in the sub-fields SF11 and SF12 in the first embodiment.

In the first embodiment, while a priming discharge period is provided in the sub-field SF12 but not in the sub-fields SF11 as shown in FIG. 8, so that whenever the sub-field SF12 is selected (gradation levels 165 through 255), the sub-field SF11 is automatically selected as well, as shown in Table 1. Similarly, whenever the sub-field SF10 is selected (gradation levels 71 through 106 and the like), the sub-field SF9 is automatically selected as well. Similar relations exist between the sub-field SF8 and the sub-field SF7, the sub-field SF6 and the sub-field SF5, the sub-field SF4 and the sub-field SF3, and the sub-field SF2 and the sub-field SF1. These and the weighting shown in Table 1 make it possible to express 256 gradations.

Figure 4:
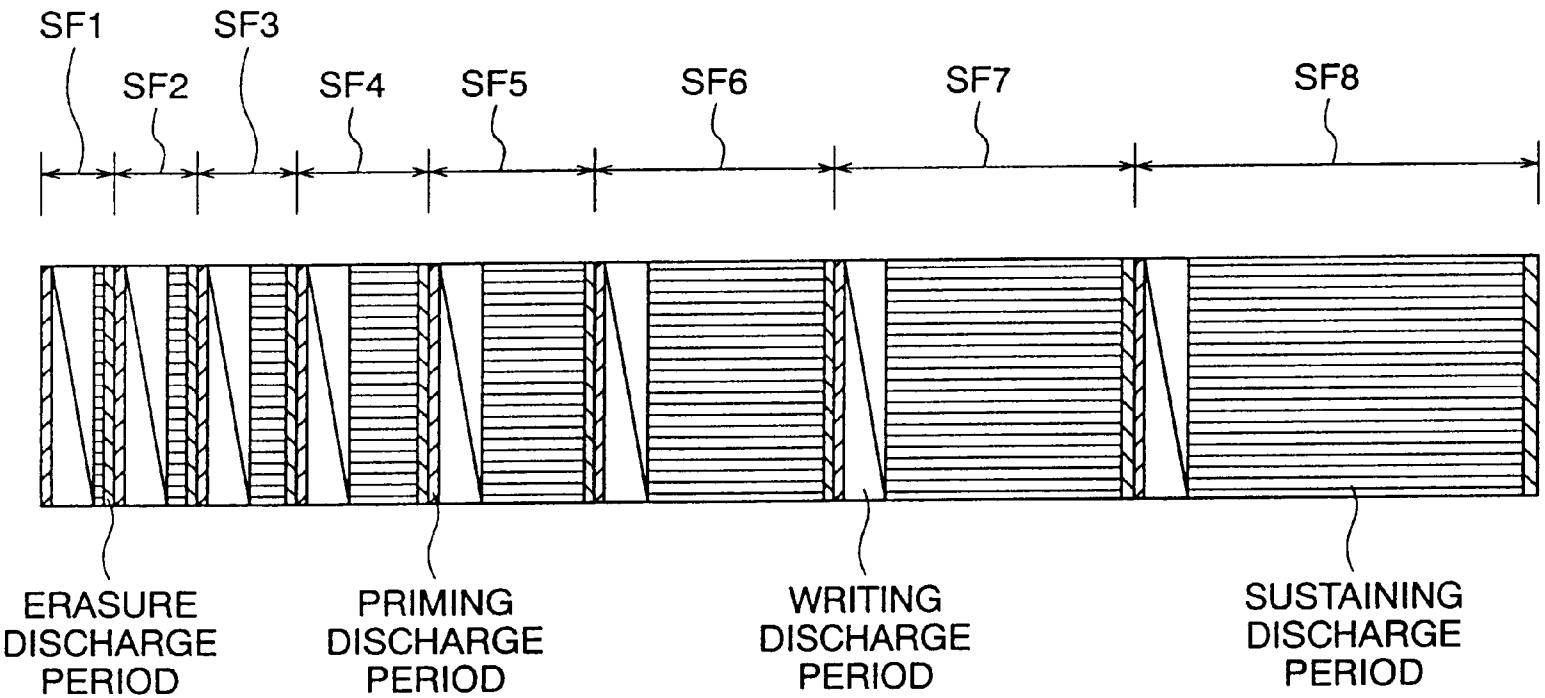
FIG. 4 (PRIOR ART)
FIG. 4 is a conceptual drawing of one frame in a prior art driving method.
Figure 5:
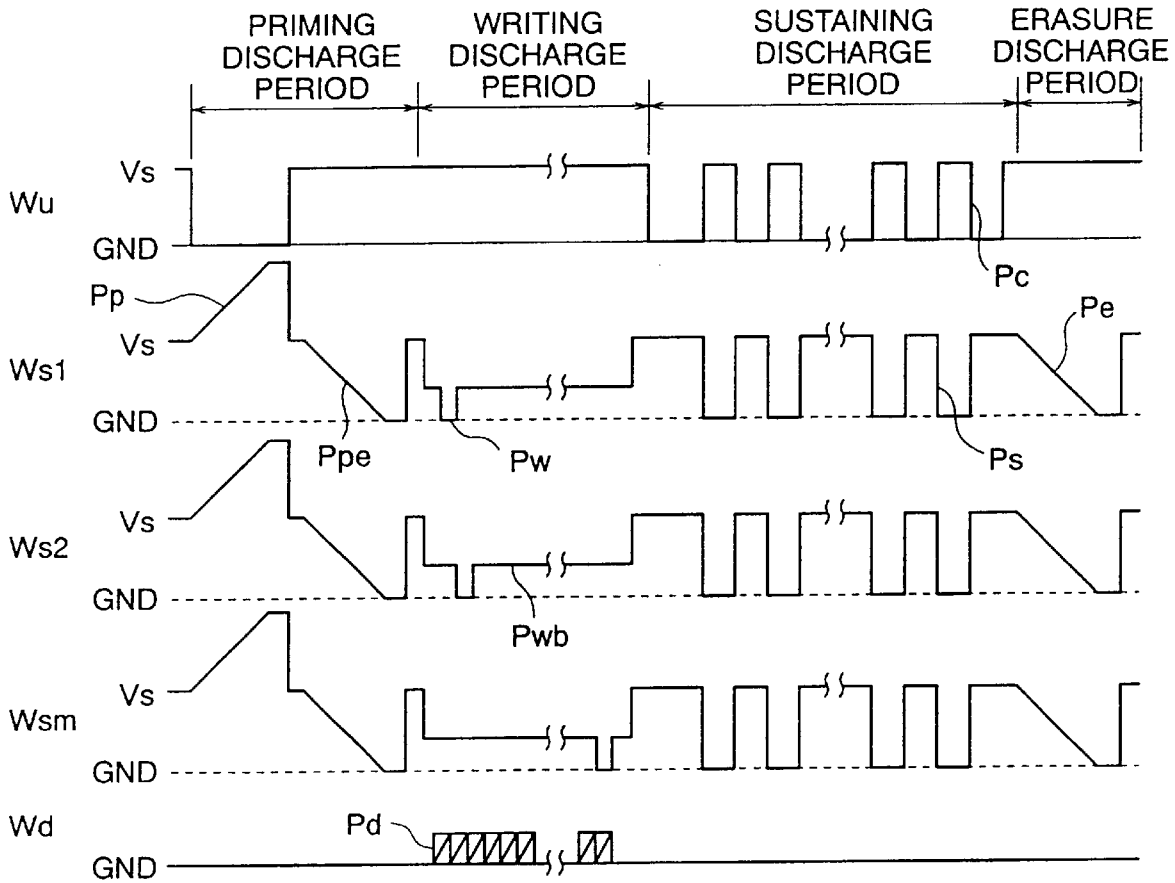
FIG. 5 (PRIOR ART)
FIG. 5 is a timing chart of waveforms of drive pulses emitted by an address driver 120, a scan driver 121, and a sustain driver 122 within one sub-field.
Figure 6:
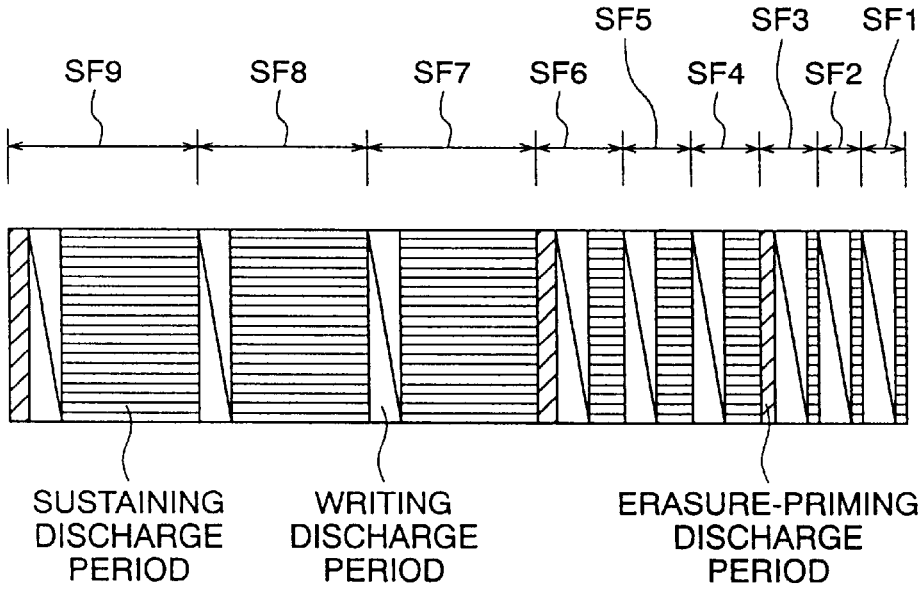
FIG. 6 (PRIOR ART)
FIG. 6 is a conceptual drawing showing one frame in a driving method for PDP according to a first prior art.
Figure 7:
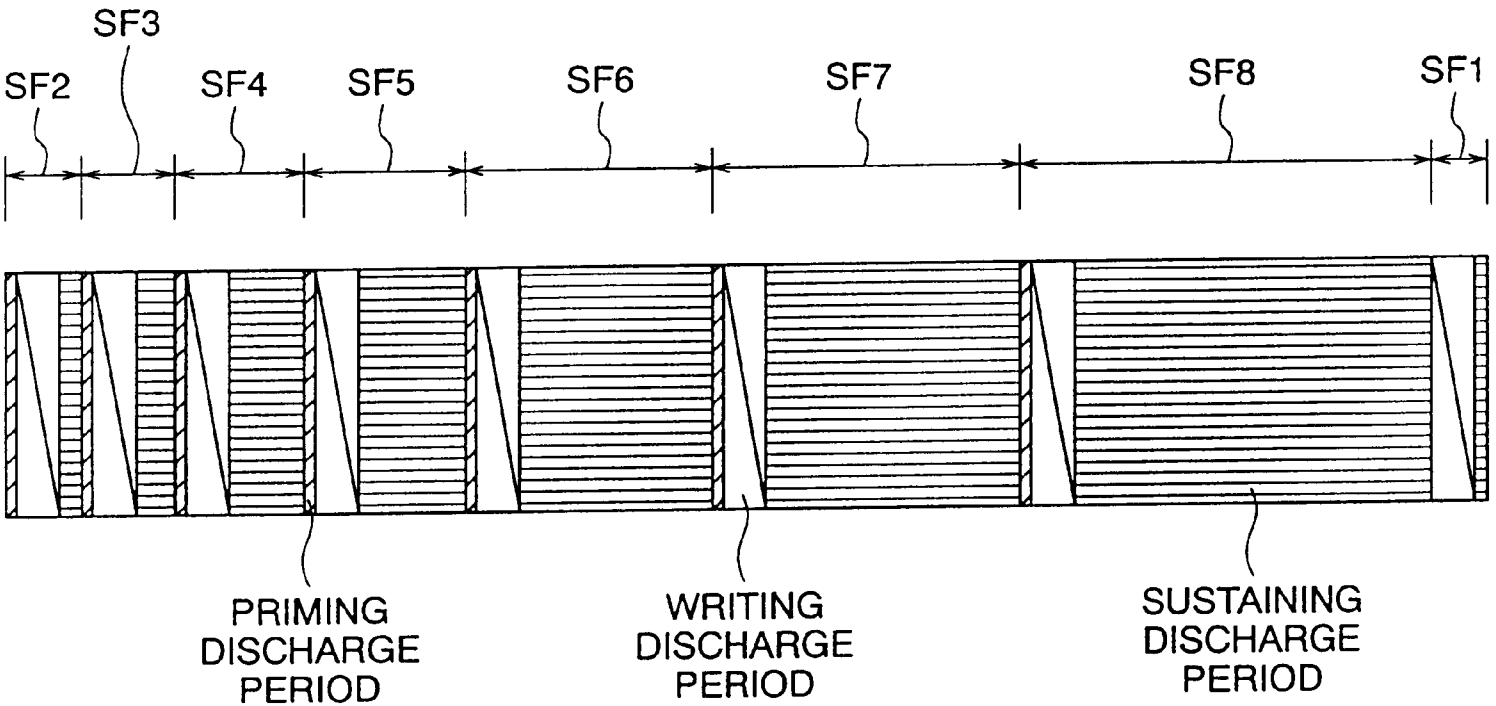
FIG. 7 (PRIOR ART)
FIG. 7 is a conceptual drawing showing one frame in a driving method for PDP according to a second prior art.

The driving method for PDP in the sub-field SF12 is identical to the driving method of prior art shown in FIG. 4 in a priming discharge period, a writing discharge period, and a sustaining discharge period. However, the sub-field SF11 does not have a priming discharge period, so that an erasure discharge period is not provided in the sub-field SF12 and the process moves on to the sub-field SF11 after the completion of the sub-field SF12 while holding wall charges accumulated by the sustaining discharge. On the other hand, the sub-field SF11 starts with a writing discharge period, followed by a sustaining discharge period and an erasure discharge period to complete it.

Figure 1:
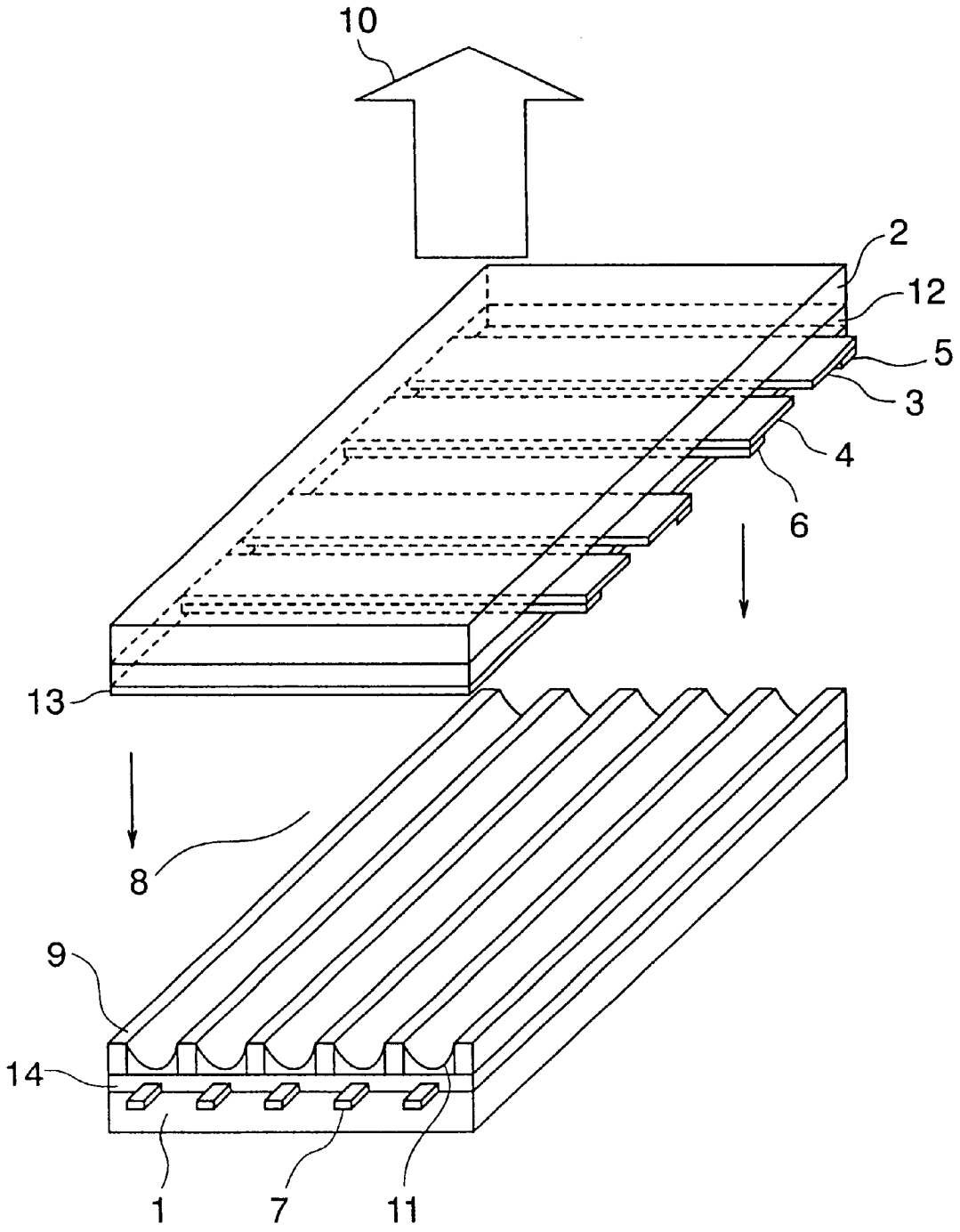
FIG. 1 (PRIOR ART)
FIG. 1 is a perspective drawing showing the structure of a display cell of an AC type PDP.
Figure 2:
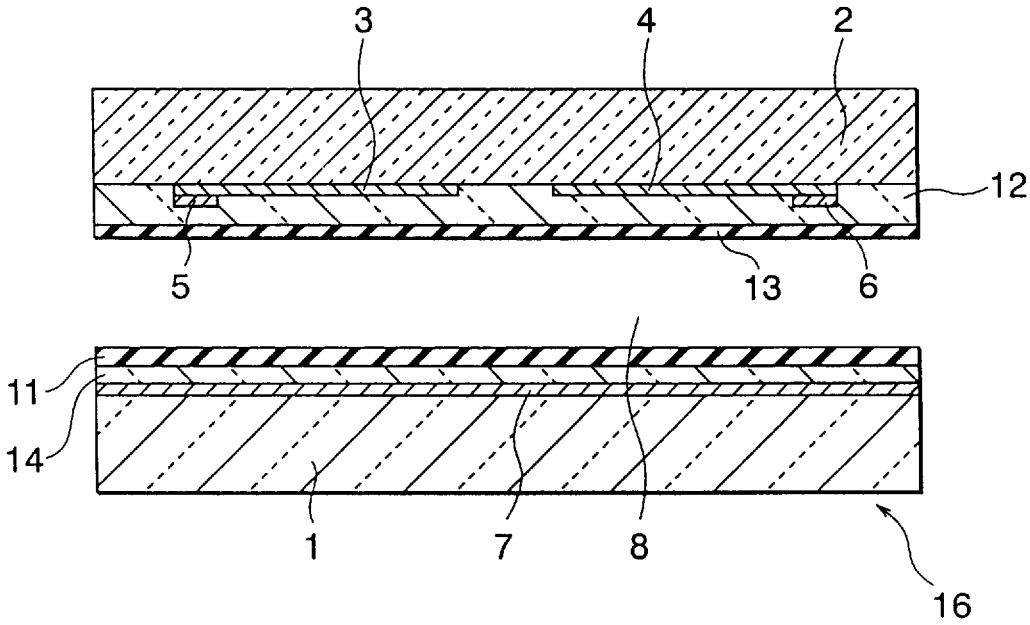
FIG. 2 (PRIOR ART)
FIG. 2 is a cross-sectional drawing showing the structure of a display cell of an AC type PDP.

In the first embodiment, for the PDP shown in FIG. 2, first of all, during the priming discharge period, the priming discharge pulse Pp is applied to the scanning electrodes X1, X2, . . . , Xm to cause discharges in all display cells in the PDP 15 as shown in FIG. 9. Next, the potential levels of the sustaining electrodes Y1, Y2, . . . Ym, are raised to the level of the sustaining voltage Vs, and the priming discharge erasure pulse Ppe is applied to the scanning electrodes X1, X2, . . . , Xm to bring down their potentials gradually to cause erasure discharges. As a result, a portion of the wall charges, which hinders the subsequent writing discharges and sustaining discharges, will be erased. The "erasure of wall charges" mentioned here means not only the erasure of entire wall discharges but also includes the "adjustment of amount of wall charges" for conducting the subsequent writing discharges and sustaining discharges smoothly.

During the writing discharge period, the certain scanning base voltage Pwb is applied to the scanning electrodes X1, X2, . . . , Xm, and the scanning pulse Pw is applied as well sequentially from the top of the scanning electrodes X1, X2, . . . , Xm. The data pulse Pd is applied selectively in synchronization with this scanning pulse Pw to the data electrodes Di ($1 \leqq i \leqq n$) in the display cells that are to make displays. Consequently, writing discharges occur and wall charges are accumulated at the cells that are to make displays.

During the sustaining discharge period, the sustaining discharge pulse Pc is applied to the sustaining electrodes Y1, Y2, . . . Ym, while the sustaining discharge pulse Ps, whose phase is 180 degrees lagging that of the sustaining discharge pulse Pc, is also applied to each scanning electrode X1, X2, . . . , Xm, so that the sustaining discharges can be repeated in order to obtain a desired intensity for each sub-field of the display cells where writing discharges occur during the writing discharge period.

Next, the process enters into the writing discharge period and the sustaining discharge period of the sub-field SF11, and then erasure discharges are generated in the sub-field SF11 as the erasure pulse Pe is applied to the scanning electrodes X1, X2, . . . , Xm in order to drop their potentials slowly. As a result, the wall charges accumulated by the application of the sustaining discharge pulses Pc and Ps are erased. The "erasure of wall charges" mentioned here also means not only the erasure of entire wall discharges but also includes the "adjustment of amount of wall charges" for conducting the subsequent writing discharges and sustaining discharges smoothly.

As can be seen in the above, in the first embodiment, the writing discharge period for the sub-field SF11 is set up after the sustaining discharge period of the sub-field SF12, so that the following discharge operations are performed in each display cell in the sub-field SF11.

In the display cells where no selective luminance occurred in the sub-field SF12, writing discharges occur based on the display data in the sub-field SF11 and wall charges are generated during the writing discharge period. During the sustaining discharge period, sustaining discharges occur based on the wall discharges. After a desired intensity is obtained as a result, wall charges will be erased by erasure discharges during the erasure discharge period to complete the sub-field. The gradation levels that generate such discharges are the gradation levels 107 through 164 shown in Table 1.

On the other hand, wall charges remain after the completion of the sub-field SF12 in the display cells where selective luminance occurred in the sub-field SF12. Polarity layout for these wall charges is determined according to the last sustaining pulse's format. In case of the first embodiment, sustaining discharges end in the condition where the potential of the scanning electrodes is the GND potential and the potential of the sustaining electrodes is the sustaining potential Vs as shown in FIG. 9, so that positive charges accumulate on the scanning electrodes whose potential is low, and negative charges accumulate on the sustaining electrodes whose potential is high. Moreover, the level of voltage applied to the scanning electrodes and the sustaining electrodes at the start of the writing period in the sub-field SF11 is set to be the same as the potential level of the last sustaining pulse in the sub-field SF12 as shown in FIG. 9. Therefore, if there is any selective luminance in the sub-field SF12, the residual wall charges act to suppress the voltages between the electrodes during the writing discharge period in the sub-field SF11, thus suppressing the discharge from happening. Consequently, the process moves into the sustaining discharge period via the writing discharge period while holding wall charges. As a consequence, the sustaining discharges and hence luminance occur during the sustaining discharge period regardless of whether the existence or lack of writing discharge in the sub-field SF11 in those cells where the selective luminance occurred during the sub-field SF12. The gradation levels where such discharges occur are the gradation levels 165 through 255 shown in Table 1.

Therefore, during the sustaining discharge period of the sub-field SF11, the sustaining discharges and hence luminance occur in both the display cells where the selective luminance occurred in the sub-field SF12 and the display cells where the writing discharges occurred in the sub-field SF11.

In the first embodiment, as shown in Table 1, the weighting $L_i$ of each sub-filed $SF_i$ is set up in such a way that the relation of an inequality $L_{n+2} \leqq L_{n+1}+L_n$ holds universally when $L_1=L_2=1$ is assumed as the initial condition. As long as the relation of this inequality formula exists, it is free to choose and combine any sub-field expressing the same gradation level, so that it is possible to make appropriate choices based on the types of display images. Thus, the first embodiment has a redundancy in comparison with the driving method of the prior art.

For example, in expressing the gradation level 7, the following three kinds of coding (I, II, III) as shown in Table 2 are possible including a coding (I) shown in Table 1.

TABLE 2

| | Weighting | | | | | | | | | | | |
|---|---|---|---|---|---|---|---|---|---|---|---|---|
| Coding | SF12 91 | SF11 58 | SF10 36 | SF9 24 | SF8 16 | SF7 11 | SF6 7 | SF5 5 | SF4 3 | SF3 2 | SF2 1 | SF1 1 |
| I | | | | | | | | | ○ | ○ | ○ | ○ |
| II | | | | | | | | ○ | | | ○ | ○ |
| III | | | | | | | | ○ | | ○ | | |

In the coding with this redundancy, if the particular image in attention changes from the gradation level 6 to the gradation level 7 and the selection sub-field of the gradation level 6 is (SF4+SF3+SF1), it is preferable to select the coding I (SF4+SF3+SF2+SF1) with a smaller luminance gravity center difference from the gradation level 6 as the gradation level 7. "Luminance gravity center" is the center in time, when the average of the change of intensity is calculated within one frame.

If the particular image in attention changes from the gradation level 6 to the gradation level 7 and the selection sub-field of the gradation level 6 is (SF5+SF1), it is preferable to select the coding II (SF5+SF2+SF1) with a smaller luminance gravity center difference from the gradation level 6 as the gradation level 7.

Furthermore, since the selection sub-field of the gradation level 8 is (SF5+SF3+SF1) if the particular image in attention changes from the gradation level 8 to the gradation level 7, it is preferable to select the coding II (SF5+SF2+SF1) or the coding III (SF5+SF3) with a smaller luminance gravity center difference from the gradation level 8 as the gradation level 7.

Moreover, in addition to the gradation level 7, there are many gradation levels that allow to choose a plurality of codings in order to suppress the luminance gravity center difference.

Thus, it is possible to select a coding method in relation to a coding method used in the image display of the previous sub-field in this embodiment to achieve excellent image quality.

The maximum number of writing discharges per frame is six in each display cell. This is because it is needed to perform only one of the writing discharges in a pair of adjacent sub-fields that do not have a priming discharge period between them. For example, if the sub-fields SF12 and SF11 are selected, only the writing discharges in the sub-field SF12 are needed; or, if the only sub-field SF11 is selected not sub-field SF12, only the writing discharges in the sub-field SF11 are needed. Thus, the power consumption for the writing discharges can be reduced to a half of what is consumed in a case of conducting writing discharges in all the sub-fields, i.e., conducting writing discharges 12 times.

Figure 10:
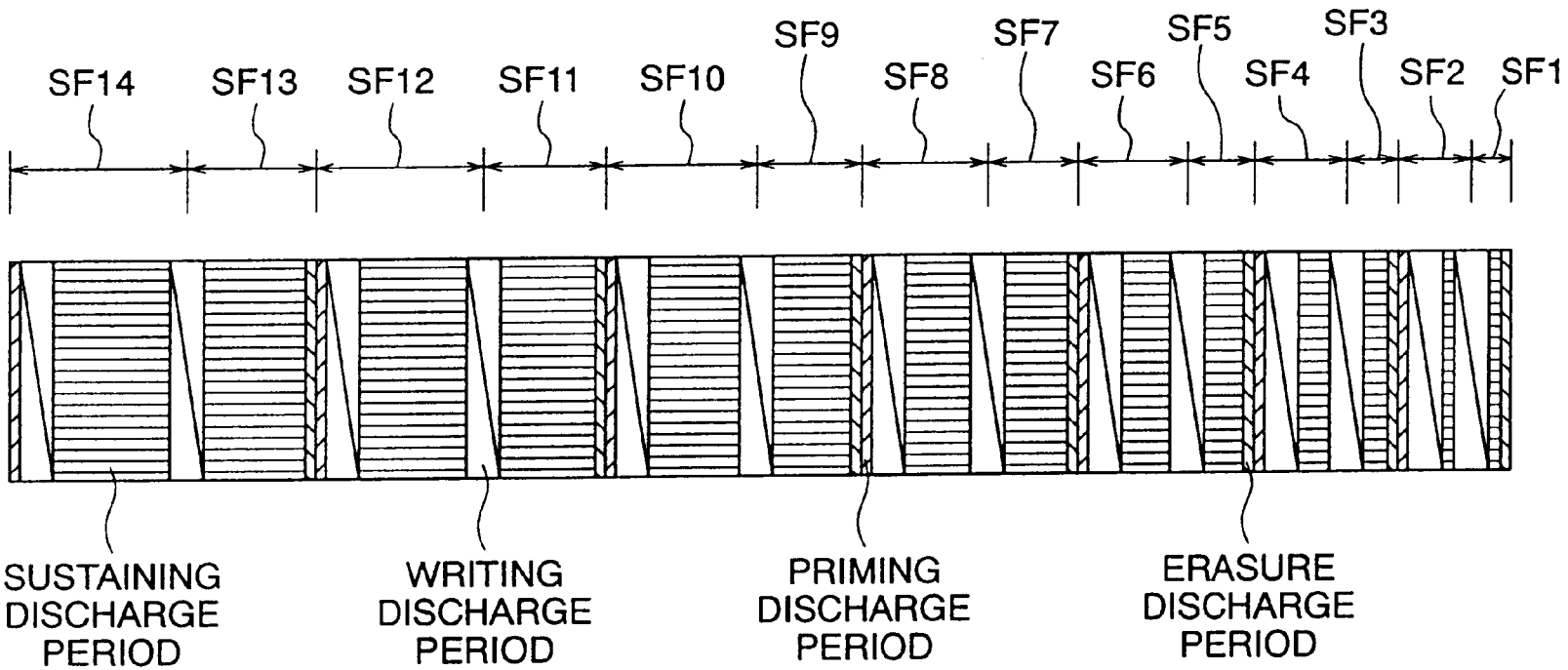
FIG. 10 is a conceptual drawing showing one frame in a driving method for PDP according to a second embodiment of the present invention.

Next, a second embodiment of the present invention will be described. FIG. 10 is a conceptual drawing showing one frame in the driving method for PDP according to the second embodiment of the invention.

In the second embodiment, one frame consists for 14 sub-fields SF1 through SF14 and one priming discharge period is provided for two sub-fields. Specifically, priming discharge periods are provided only for SF2, SF4, SF6, SF8, SF10, SF12, and SF14, and no priming periods are provided for SF1, SF3, SF5, SF7, SF9, SF11, and SF13.

A coding method in the second embodiment is shown in Table 3. Table 3 shows the relation between the weighting of the intensity of each sub-field and the gradation level expressed by their combinations in the second embodiment.

TABLE 3

| | Weighting | | | | | | | | | | | | | |
|---|---|---|---|---|---|---|---|---|---|---|---|---|---|---|
| Gradation level | SF14 64 | SF13 47 | SF12 36 | SF11 28 | SF10 21 | SF9 17 | SF8 13 | SF7 10 | SF6 7 | SF5 5 | SF4 3 | SF3 2 | SF2 1 | SF1 1 |
| 0 | | | | | | | | | | | | | | |
| 1 | | | | | | | | | | | | | | ○ |
| 2 | | | | | | | | | | | | | ○ | ○ |
| 3 | | | | | | | | | | | | ○ | | ○ |
| 4 | | | | | | | | | | | | ○ | ○ | ○ |
| 5 | | | | | | | | | | | ○ | ○ | | |
| 6 | | | | | | | | | | | ○ | ○ | | ○ |
| 7 | | | | | | | | | | | ○ | ○ | ○ | ○ |
| 8–12 | | | | | | | | | | ○ | | Same as gradation level 3–7 | | |
| 13–19 | | | | | | | | | ○ | ○ | | Same as gradation level 1–7 | | |
| 20–29 | | | | | | | | ○ | | | Same as gradation level 10–19 | | | |
| 30–42 | | | | | | | ○ | ○ | | | Same as gradation level 7–19 | | | |
| 43–59 | | | | | | ○ | | | Same as gradation level 16–42 | | | | | |
| 60–80 | | | | | ○ | ○ | | | Same as gradation level 22–42 | | | | | |
| 81–108 | | | | ○ | | | | Same as gradation level 53–80 | | | | | | |

TABLE 3-continued

| Gradation level | Weighting | | | | | | | | | | | | | |
|---|---|---|---|---|---|---|---|---|---|---|---|---|---|---|
| | SF 14 64 | SF 13 47 | SF 12 36 | SF 11 28 | SF 10 21 | SF9 17 | SF8 13 | SF7 10 | SF6 7 | SF5 5 | SF4 3 | SF3 2 | SF2 1 | SF1 1 |
| 109–144 | | | ○ | ○ | | | | Same as gradation level 45–80 | | | | | | |
| 145–191 | | ○ | | | | | | Same as gradation level 98–144 | | | | | | |
| 192–255 | ○ | ○ | | | | | | Same as gradation level 81–144 | | | | | | |

Figure 3:
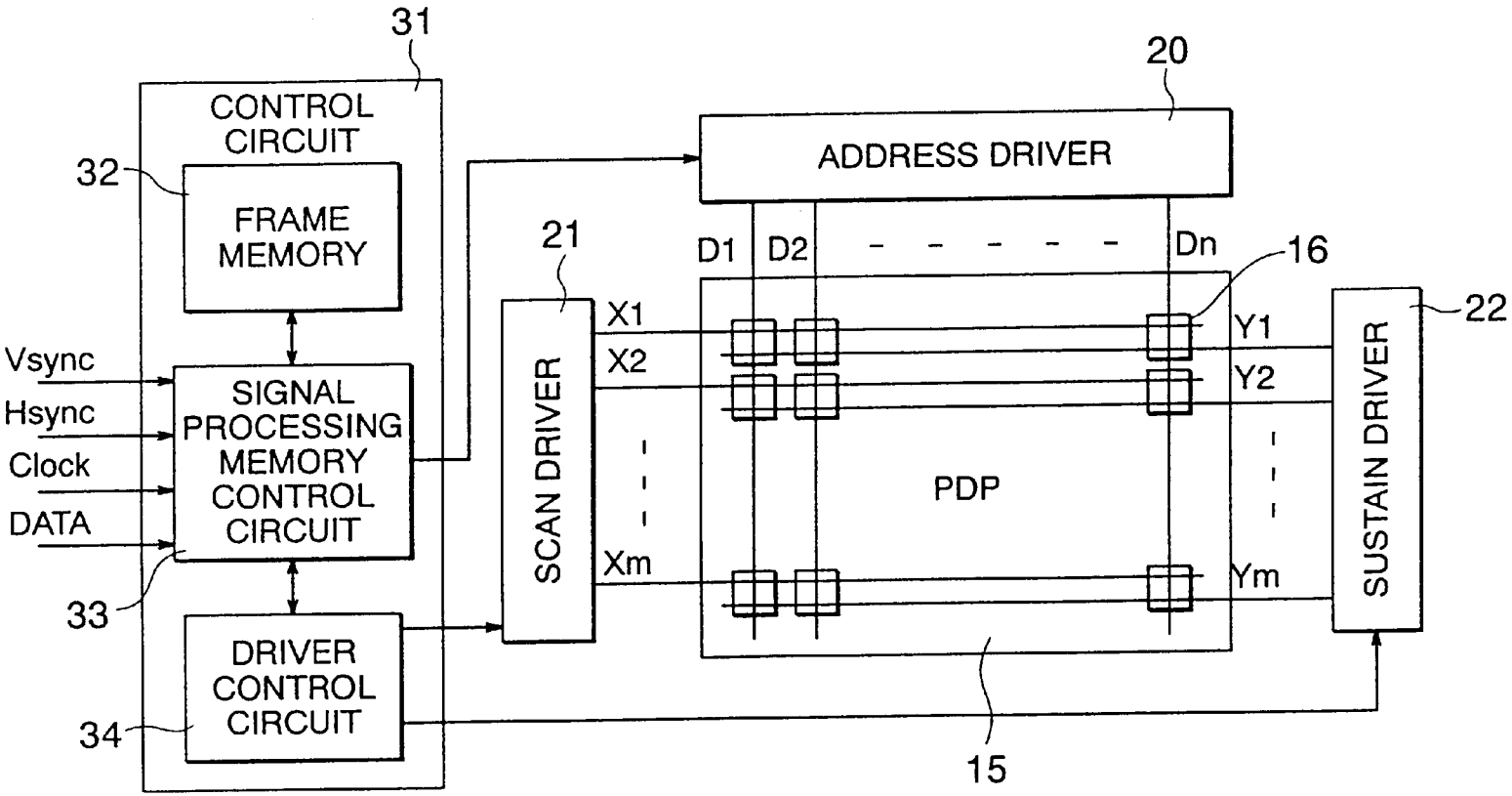
FIG. 3 (PRIOR ART)
FIG. 3 is a block diagram showing the outline structure of a PDP formed by arranging display cells shown in FIG. 2 in a matrix as well as control circuits and drivers for the PDP.

The pulse waveforms and others in each sub-field in the second embodiment is identical to those in the first embodiment except that the odd number sub-fields and the even number sub-fields area exchanged their positions. The coding in the second embodiment is also the same as in the first embodiment and sub-fields are weighted in such a way that the relation of an inequality $L_{n+2} \leqq L_{n+1}+L_n$ holds when $L_1=L_2=1$ is assumed as the initial condition. Consequently, the weighting shown in FIG. 3 makes the expression of 256 gradations possible and provides the necessary redundancy.

In contrast with the first embodiment, the second embodiment has more sub-fields that constitute a frame, so that it has a higher redundancy for gradation expression, particularly in the upper sub-fields, i.e., in the sub-fields with higher numbers of sustaining cycles, thus realizing a better image quality.

For example, the comparison with the first embodiment in terms of coding for expressing the gradation level 128 is as shown below. Tables 4 and 5 show the coding that can express the gradation level 128 in the first and second embodiments respectively.

When expressing the gradation level 128 in the first embodiment, thougn only two kinds of coding (1-*a* and 1-*b*) are possible, twelve kinds of coding (2-*a* through 2-*l*) are possible in expressing the gradation level 128 in the second embodiment, as shown in Tables 4 and 5.

In the first and second embodiments, when a sub-field, which is set up ahead of the other in a pair of adjacent sub-fields having no priming discharge period between them, is selected, the other sub-field, which is set up later, becomes selected automatically. They are weighted in such a way that the relation of an inequality $L_{n+2} \leqq L_{n+1}+L_n$ holds when $L_1=L_2=1$ is assumed as the initial condition. In other words, the weighting of the sub-field just above these adjacent two sub-fields is equal or less than the sum of the weighting of the adjacent two sub-fields. Therefore, it realizes a coding for selecting the lower sub-field even if the intensity level increases one step. Therefore, it is possible to decrease the movement of the luminance gravity center averaged within one frame, consequently reducing the occurrence of dynamic image false contour.

Next, a third embodiment of the invention will be described. FIG. 11 is a conceptual drawing showing one frame in the driving method for PDP according to the third embodiment of the present invention.

TABLE 4

| Coding | Weighting | | | | | | | | | | | |
|---|---|---|---|---|---|---|---|---|---|---|---|---|
| | SF 12 91 | SF 11 58 | SF 10 36 | SF9 24 | SF8 16 | SF7 11 | SF6 7 | SF5 5 | SF4 3 | SF3 2 | SF2 1 | SF1 1 |
| 1-a | | ○ | | ○ | ○ | ○ | ○ | ○ | ○ | ○ | ○ | ○ |
| 1-b | | ○ | ○ | ○ | | | | ○ | ○ | ○ | | |

TABLE 5

| Coding | Weighting | | | | | | | | | | | | | |
|---|---|---|---|---|---|---|---|---|---|---|---|---|---|---|
| | SF 14 64 | SF 13 47 | SF 12 36 | SF 11 28 | SF 10 21 | SF9 17 | SF8 13 | SF7 10 | SF6 7 | SF5 5 | SF4 3 | SF3 2 | SF2 1 | SF1 1 |
| 2-a | | | ○ | ○ | ○ | ○ | | ○ | ○ | ○ | | ○ | ○ | ○ |
| 2-b | | | ○ | ○ | ○ | ○ | ○ | ○ | | | | ○ | | ○ |
| 2-c | | ○ | | ○ | ○ | ○ | | ○ | | | ○ | ○ | | |
| 2-d | | ○ | | ○ | ○ | ○ | | ○ | | ○ | | | | |
| 2-e | | ○ | ○ | ○ | | | | | ○ | ○ | ○ | ○ | | |
| 2-f | | ○ | ○ | ○ | | | | ○ | | | ○ | ○ | ○ | ○ |
| 2-g | | ○ | ○ | ○ | | | | ○ | | ○ | | | ○ | ○ |
| 2-h | | ○ | ○ | ○ | | | | ○ | | ○ | | ○ | | |
| 2-i | ○ | ○ | | | | | | | ○ | ○ | ○ | ○ | | |
| 2-j | ○ | ○ | | | | | | ○ | | | ○ | ○ | ○ | ○ |
| 2-k | ○ | ○ | | | | | | ○ | | ○ | | | ○ | ○ |
| 2-l | ○ | ○ | | | | ○ | | | | | | | | |

In the third embodiment, one frame consists for 12 sub-fields SF1 through SF12 and 10 priming discharge periods are provided for 12 sub-fields. Specifically, priming discharge periods are provided only for SF2, SF3, SF4, SF5, SF6, SF7, SF8, SF9, SF10, and SF12, and no priming periods are provided for SF1 and SF11.

In the third embodiment also, the weighting $L_i$ of each sub-filed $SF_i$ is set up in such a way that the relation of an inequality $L_{n+2} \leqq L_{n+1}+L_n$ holds universally when $L_1=L_2=1$ is assumed as the initial condition.

In comparison with the first embodiment, the third embodiment has a higher number of priming discharge cycles, so that the background intensity increases, and it is possible to select intermediate intensity sub-fields independently as all of the sub-fields SF10 through SF2 have priming discharge periods. Therefore, the redundancy for sub-field selection increases and dynamic image false contours can be further reduced compared to the first embodiment.

The third embodiment is particularly effective when the display cell size is relatively small and the priming discharge intensity can be reduced by holding the priming discharge voltage lower.

Next, a fourth embodiment of the present invention will be described. The fourth embodiment is a driving method for varying the number of priming discharge cycles according to the average picture level (APL). FIGS. 12A through 12D are conceptual drawings showing one frame in the driving method for PDP according to the fourth embodiment of the present invention, as the APL increases from FIG. 12A toward FIG. 12D successively.

As shown in FIGS. 12A through 12D, in the fourth embodiment, the number of priming discharge cycles is reduced when the APL is small, and the number of priming discharge cycles is increased when the APL is larger.

Figures 12A, 12B, 12C, 12D:
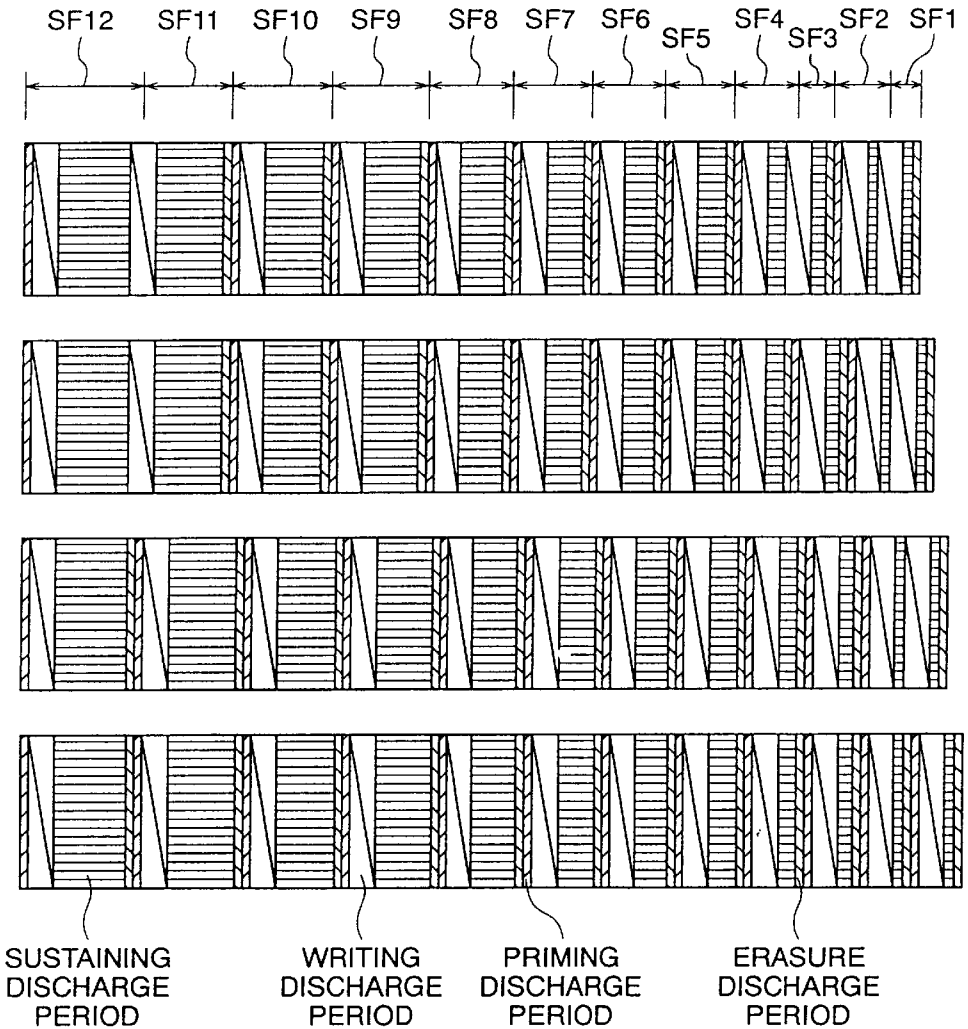

Priming discharge periods are provided in nine sub-fields, i.e., SF2, SF4, SF5, SF6, SF7, SF8, SF9, SF10, and SF12 when the APL assumes the smallest value as shown in FIG. 12A.

Priming discharge periods are provided in 10 sub-fields, i.e., SF2, SF3, SF4, SF5, SF6, SF7, SF8, SF9, SF10, and SF12 when the APL assumes the next smallest value as shown in FIG. 12B.

Priming discharge periods are provided in 11 sub-fields, i.e., SF2, SF3, SF4, SF5, SF6, SF7, SF8, SF9, SF10, SF11, and SF12 when the APL assumes the next smallest value as shown in FIG. 12C.

When the APL assumes the largest value, priming discharge periods are provided in all the sub-fields SF1 through SF12 as shown in FIG. 12D.

Table 6 shows an example coding method in the fourth embodiment. Table 6 shows the relation between the weighting of each sub-field in the frame structures in FIG. 12A through FIG. 12D and the gradation levels that can be expressed by their combinations.

A wide variety of image displays exist in general from such an image of snow covered mountains having a large APL to such an image of a night sky having a small APL, and APL of image signal varies widely. Although an image of snow covered mountains with a relatively large background intensity does not affect the visual sensation of human eyes very much, the contrast feeling in case of an image of a night sky reduces substantially compared to an image of snow covered mountains as most of the display region can be the background intensity itself.

The fourth embodiment is a driving method, in consideration of such a characteristic, for reducing dynamic image false contours by providing a maximum redundancy in coding by generating priming discharges in every sub-field when APL is larger, and improving contrasts by using a fewer priming discharge cycles if APL is small.

In case of such an image where stars are twinkling in a dark night sky, movement of the image causes very little dynamic image false contours so that reducing the number of priming discharge cycles does not affect the image quality so much. Consequently, the fourth embodiment can achieve the improvement of the contrast and improve the general image quality at the same time.

Furthermore, it can keep a smoother background intensity change as priming discharge frequency changes occur one at a time as shown in FIG. 12A through FIG. 12D.

Next, a fifth embodiment of the invention will be described. The fifth embodiment is the driving method wherein the numbers of priming discharge cycles and the sustaining discharge cycles are changed according to the average picture level (APL). FIGS. 13A through 13F are conceptual drawings showing one frame in the driving method for PDP according to the fifth embodiment indicating a case in which APL is gradually increasing from FIG. 13A toward 13F.

As shown in FIGS. 13A through 13F in the fifth embodiment, the number of priming discharge cycles is reduced while the number of sustaining discharge cycles is increased when the APL is small, and the number of priming discharge cycles is increased while the number of sustaining discharge cycles is decreased when the APL is larger.

Figures 13A, 13B, 13C, 13D, 13E, 13F:
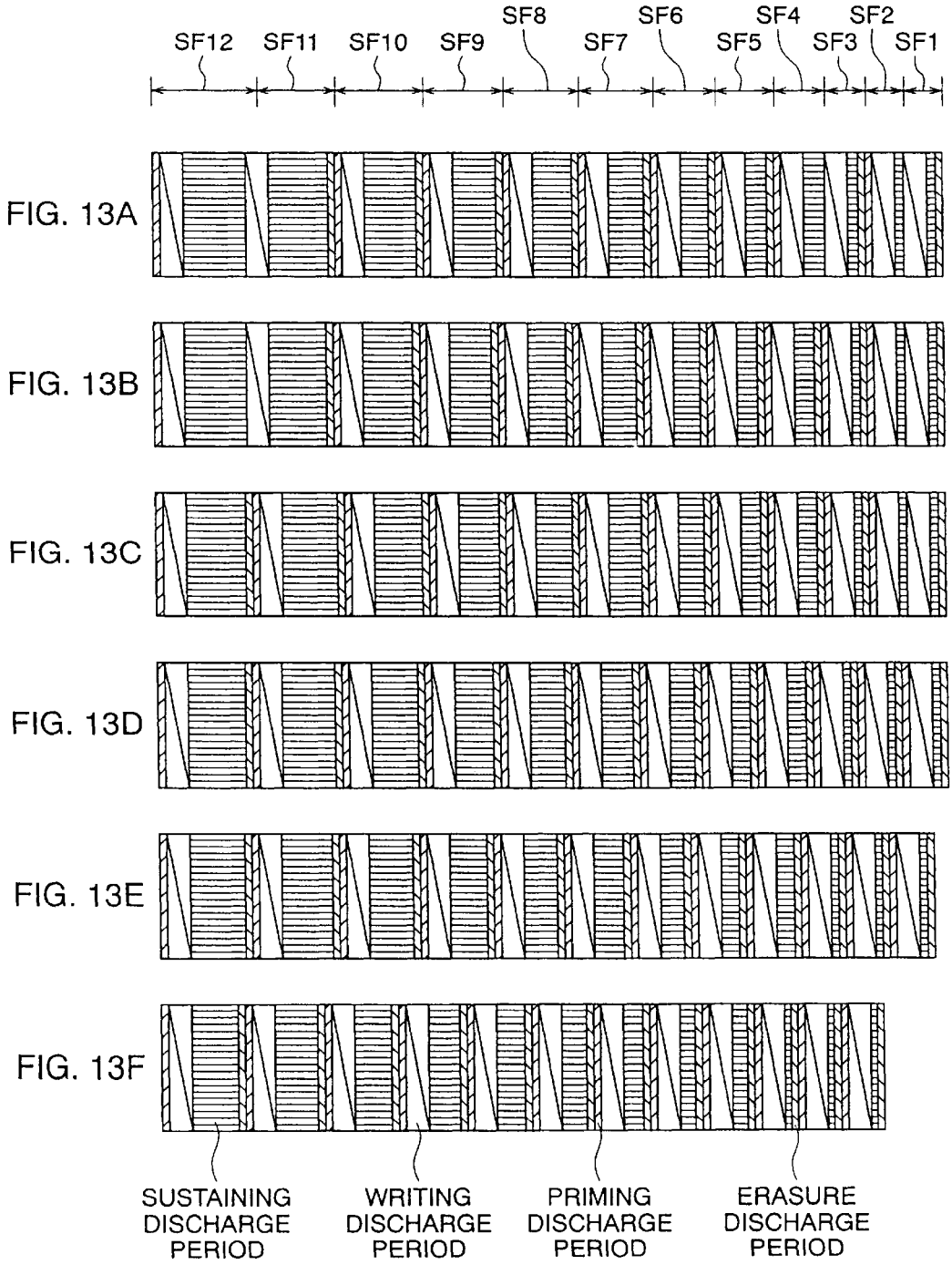

Priming discharge periods are provided in nine sub-fields, i.e., SF2, SF4, SF5, SF6, SF7, SF8, SF9, SF10, and SF12 when the APL assumes the smallest value as shown in FIG. 13A.

Priming discharge periods are provided in 10 sub-fields, i.e., SF2, SF3, SF4, SF5, SF6, SF7, SF8, SF9, SF10, and SF12 when the APL assumes the next smallest value as shown in FIG. 13B.

Priming discharge periods are provided in 11 sub-fields, i.e., SF2, SF3, SF4, SF5, SF6, SF7, SF8, SF9, SF10, SF11, and SF12 when the APL assumes the next smallest as shown in FIG. 13C.

TABLE 6

| | Weighting | | | | | | | | | | | |
|---|---|---|---|---|---|---|---|---|---|---|---|---|
| Coding | SF 12 | SF 11 | SF 10 | SF9 | SF8 | SF7 | SF6 | SF5 | SF4 | SF3 | SF2 | SF1 |
| (a) | 50 | 46 | 44 | 35 | 27 | 21 | 15 | 9 | 3 | 3 | 1 | 1 |
| (b) | 50 | 46 | 43 | 34 | 26 | 20 | 15 | 10 | 6 | 3 | 1 | 1 |
| (c) | 51 | 46 | 42 | 34 | 26 | 20 | 15 | 10 | 6 | 3 | 1 | 1 |
| (d) | 56 | 47 | 39 | 31 | 25 | 19 | 14 | 10 | 7 | 4 | 2 | 1 |

When the APL assumes a larger value than that, priming discharge periods are provided in all the sub-fields SF1 through SF12 as shown in FIGS. 13D through 13F.

As to the number of sustaining discharge cycles, the sustaining discharge period is controlled to maintain the intensity weighting constant in FIG. 13A through FIG. 13D by shortening the period gradually, for example.

The peak intensity enhancing control method, in which the power consumption is reduced by using a smaller sustaining discharge cycle when the average picture level of the image signal is larger, and a sustaining discharge cycle is made higher in order to increase the intensity in smaller regions to bring out a high contrast feeling when the average picture level is lower, is a well-known driving method. The number of priming discharge cycles is reduced when APL is small in this embodiment, so that the reduced time can be allocated to further increase the sustaining discharge period. Therefore, it can further improve the peak intensity compared to the simple peak intensity enhancing control method of the prior art. Consequently, as a whole, suppressing the background intensity can further increase the peak intensity, so that a higher contrast can be achieved.

In the present invention, the number of sub-fields, the number of coding, and the amount of change in the priming discharge cycles are not limited to those indicated in the first through fifth embodiments.

Although the first through fifth embodiments show the driving method that causes the display cells selectively illuminated in write-selection-type, in other words, the driving method that generates wall charges by causing the discharge to occur in the display cells during the writing discharge period, it is also possible to use another driving method that causes the display cells selectively illuminated in erasure-selection-type, in other words, the driving method that keeps wall charges generated without erasing during the discharge and selectively erase the cells that are not displayed during the writing discharge period. FIG. 14 is a conceptual drawing showing one frame in the driving method where selective luminance is generated in the erasure-selection-type.

When the selective luminance is generated in the erasure-selection-type one, conducting the erasure selection during the writing discharge period in a sub-field, which is ahead of the other in a pair of adjacent sub-fields that have no priming discharge between them causes the other sub-field also non-displaying automatically. For example, between the sub-field SF7 and the sub-field SF8 in FIG. 14, selecting the leading cell by the erasure discharge during the writing discharge period in the sub-field SF7 causes the trailing sub-field SF8 non-displaying automatically.

On the other hand, conducting the erasure selection only in the trailing sub-filed causes only the leading sub-field to display. For example, if the erasure selection is not performed during the writing discharge period in the sub-field SF7, and the erasure selection is performed only in the writing discharge period in the sub-field period SF8, only the leading sub-field SF7 will be in displaying state.

Also, if the erasure selection is made in neither sub-field, both sub-fields will be in displaying state. This is opposite to the write-selection-type coding.

Although the plasma display panels according to the first through five embodiments are all AC types, the invention is not limited to the AC type plasma display panels, but rather can be applied to the DC type plasma display panels as well.

What is claimed is:

1. A driving method for a plasma display panel wherein gradation is expressed by dividing one frame into a plurality of sub-fields, said driving method comprising the steps of:

preparing frames in each of which number of priming discharge periods is set up in relation to an average picture level of images, the number of sub-fields in each of said frames being equal to one another;

selecting a frame from said frames in accordance with an average picture level;

conducting sustaining discharges in a first sub-field as a pair of adjacent first and second sub-fields; and conducting writing discharges in said second sub-field after said sustaining discharges in said first sub-field without conducting any erasure discharge between said sustaining discharges and said writing discharges when the number of priming discharge periods in a selected frame is less than the number of sub-fields in said selected frame, wherein the higher the average picture level, the higher the number of priming discharges is set up in said frame.

2. The driving method for plasma display panel according to claim 1, further comprising the step of matching a polarity of writing discharge pulse at the start of said writing discharges in said second sub-field with a polarity of sustaining discharge pulse at the end of said sustaining discharge in said first sub-field.

3. The driving method for plasma display panel according to claim 1, wherein said first and second sub-fields are set up alternately in said frame.

4. The driving method for plasma display panel according to claim 1, wherein the number of said first sub-fields is less than half of the total number of said plurality sub-fields consisting of said one frame.

5. The driving method for plasma display panel according to claim 1, further comprising a step of selecting one or more sub-fields, in case that grading levels of input image signals change, so as to make a difference least between luminance gravity centers of the gradation levels before and after the change.

6. The driving method for plasma display panel according to claim 1, wherein the number of sustaining discharges is also set in relation to said average picture level.

7. The driving method for plasma display panel according to claim 6, wherein the higher the average picture level, the lower the number of sustaining discharges is set up in said frame.

* * * * *